US006203681B1

(12) United States Patent
Yang

(10) Patent No.: US 6,203,681 B1
(45) Date of Patent: Mar. 20, 2001

(54) METHODS OF FABRICATING DISPLAY SCREENS USING ELECTROPHORETIC DEPOSITION

(75) Inventor: Jianping P. Yang, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/306,936

(22) Filed: May 7, 1999

(51) Int. Cl.[7] ..... C08F 2/58; C09D 5/44; C25D 13/00; C25D 15/00

(52) U.S. Cl. ..... 204/489; 204/471; 204/507; 204/490

(58) Field of Search ..... 204/471, 489, 204/490, 507

(56) References Cited

U.S. PATENT DOCUMENTS

| | | | | |
|---|---|---|---|---|
| 5,296,117 | | 3/1994 | De Jaeger et al. . | |
| 5,582,703 | | 12/1996 | Sluzky et al. . | |
| 5,638,048 | | 6/1997 | Lu et al. . | |
| 5,667,655 | * | 9/1997 | Libman et al. | 204/485 |
| 5,697,824 | * | 12/1997 | Xie et al. | 445/24 |

OTHER PUBLICATIONS

Jean A. Siracuse et al.; "Cataphoretic Deposition of Phosphor"; *J. Electrochem. Soc.*, vol. 137, No. 7, Jul. 1990, pp. 2336–2340.

Michael J. Shane et al.; "Electrophoretic Deposition of Phosphors"; *Journal of Colloid and Interface Science*, vol. 165, 1994); pp. 334–340 No Month Avail.

Esther Sluzky et al.; "Electrophoretic Preparation of Phosphor Screens"; *J. Electrochem. Soc.*, vol. 136, No. 9, Sep. 1989, pp. 2724–2727.

S. A. Bukesov et al.; "Electrophysical characteristics and low–energy cathodoluminescence of vacuum fluorescent display and field emission display screens"; *J. Vac. Sci. Technol.*, vol. B, No. 4, Jul./Aug. 1998; pp. 2082–2085.

* cited by examiner

*Primary Examiner*—Kathryn Gorgos
*Assistant Examiner*—Wesley A. Nicolas
(74) *Attorney, Agent, or Firm*—Wells, St. John, Roberts, Gregory & Matkin, P.S.

(57) ABSTRACT

In one aspect, the invention encompasses a method of fabricating a display screen. Phosphor molecules are electrophoretically deposited onto a substrate in a first solution having a first hydroxide ion concentration. The deposited phosphor molecules are then rinsed with second solution having an hydroxide ion concentration greater than the first hydroxide ion concentration. In another aspect, the invention encompasses a method of depositing phosphor molecules over selected regions of a substrate. Conductive regions are formed over portions of a substrate while non-conductive regions are left over other portions of the substrate. Phosphor molecules are electrophoretically deposited onto the conductive regions of the substrate in a first solution having a first hydroxide ion concentration. The substrate is then rinsed with a second solution having a second hydroxide ion concentration. The second hydroxide ion concentration is greater than the first hydroxide ion concentration. After the rinsing, the deposited phosphor molecules are dried. In yet another aspect, the invention encompasses a method of forming an FED device.

13 Claims, 3 Drawing Sheets

METHODS OF FABRICATING DISPLAY SCREENS USING ELECTROPHORETIC DEPOSITION

PATENT RIGHTS STATEMENT

This invention was made with Government support under Contract No. DABT63-94-C-0012 awarded by Advanced Research Projects Agency (ARPA). The Government has certain rights in this invention.

TECHNICAL FIELD

The invention pertains to methods of fabricating display screens. In particular embodiments, the invention pertains to methods of reducing precipitate formation in a phosphor-containing solution during electrophoretic deposition of phosphor, and to methods of depositing phosphor over selected regions of a substrate.

BACKGROUND OF THE INVENTION

Phosphor-containing display devices have numerous applications, including, for example, utilization as TV screens and computer monitors. Phosphor-containing display devices generally utilize one or more components to project electrons against a phosphor to cause one or both of fluorescence or phosphorescence, and to thereby cause an image to be displayed. Exemplary components which can be utilized to generate electrons are cathode ray tubes, and cathode emitter arrays.

An exemplary phosphor-containing display device 40 is described with reference to FIG. 1. Device 40 is a field emission display (FED) device comprising a plurality of phosphor molecules 33 (only some of which are labeled) coated over a conductive layer 34, which in turn is over a transparent display screen 35. The phosphor molecules can also be referred to as "phosphor". Conductive layer 34 can comprise, for example, indium tin oxide, and transparent screen 35 can comprise, for example, glass. Screen 35 can be referred to as a face plate. Device 40 further comprises a base plate 12 spaced from face plate 35, and which can also comprise glass. A conductive layer 14 is over base plate 12, and can comprise, for example, conductively-doped semiconductive material.

Emitters 26 are formed over and in electrical connection with conductive material 14. Dielectric regions 28 (only some of which are labeled) and an extraction grid 30 (only some of which is labeled) are formed over layer 14 and proximate emitters 26. Insulative spacers 32 are provided to support face plate 35 in a spaced relation relative to base plate 12. A power source 37 is provided to supply a voltage differential between conductive layer 34, conductive layer 14, and emitter grid 30.

In operation, cathode emitters 26 are electrically stimulated to cause electrons 36 (shown as dashed lines, and only some of which are labeled) to be ejected from emitters 26 and against phosphor molecules 33. The electrons then cause one of both of phosphorescence and fluorescence by phosphor molecules 33 to result in an image being displayed. Such image can be viewed by a user looking through transparent face plate 35.

The individual phosphor molecules 33 can all comprise a single uniform color (such as, for example, green) or can comprise a multitude of colors, depending on the application. Frequently, three colors of phosphor molecules 33 (for instance, red, green and blue) are provided. Each of the three colors is formed in a specific region separate from the others of the three colors, and the specific regions are surrounded by black regions.

Methodology for forming phosphor-coated face plate 35 is described with reference to an electrophoretic deposition system 70 illustrated in FIG. 2. System 70 comprises an electrophoretic deposition bath 50 contained within a vessel 51. Glass plate 35, having conductive layer 34 formed thereover, is placed within electrophoretic deposition bath 50. Conductive material 34 is utilized as a first electrode within bath 50, and a second electrode 52 is also provided within bath 50. A power source 53 is provided to electrically charge electrodes 34 and 52, with electrode 34 being charged as a negative electrode and electrode 52 being charged as a positive electrode.

Bath 50 typically comprises a mixture of isopropyl alcohol, glycerol and water, within which phosphor particles and metal complexes are dissolved. Additional electrolyte ions, besides the phosphor particles and metal ions of the metal complexes, can also be dissolved within solution 50. An exemplary solution 50 comprises 80 milligrams of isopropyl alcohol (99.5% pure), 0.35 grams of phosphor, 0.2 grams of glycerol (100% pure), and 0.025 grams of one or both of $In(NO_3)_2$ and $Ce(NO_3)_3.H_2O$.

In operation, power applied from source 53 generates a negative potential at conductive layer 34 which attracts positively charged ions 63 to a surface of conductive layer 34. The positively charge ions comprise phosphor molecule ions and metal ions. The negative potential at conductive layer 34 also causes hydrolysis of water to form hydroxide ions adjacent the surface of conductive layer 34. The hydroxide ions and metal ions interact with the phosphor particle surface to form a complex which adheres to surface 34.

In particular applications, conductive material 34 can be formed in a pattern over face plate 35 as shown in FIG. 3. Such pattern leaves some portions 37 of face plate 35 uncovered with conductive material 34. Since the phosphor molecule ions selectively deposit on conductive material 34, the patterning of conductive material 34 shown in FIG. 3 can result in the phosphor molecules being deposited in a pattern corresponding to the pattern of conductive material 34 over face plate 35. Portions 37 of glass plate 35 between regions of conductive material 34 can be either covered with a protective layer (such as, for example, photoresist) prior to the electrophoretic deposition of phosphor molecules, or left exposed to the deposition conditions.

After the electrophoretic deposition described with reference to FIG. 2, face plate 35 is removed from deposition bath 50 and rinsed with isopropyl alcohol. Such rinsing preferably leaves the complexes of phosphor molecule ions, metal ions and hydroxide ion over conductive material 34, while removing phosphor particles from regions where the particles are unintended to be deposited.

After the rinsing, face plate 35 is dried by, for example, thermal dehydration or infrared radiation dehydration.

In embodiments in which multiple colors of phosphor molecules are to be deposited over a single face plate, the electrophoretic deposition and rinsing will be repeated for each color of phosphor molecule that is to be deposited. For instance, if red, green and blue phosphor molecules are to be deposited on a glass substrate, a first lithography, first electrophoretic deposition and subsequent isopropyl rinse will be done with one of the three colors of phosphor molecules, and subsequently a second and third lithography, electrophoretic deposition and isopropyl rinse will be done with each of the remaining two colors of phosphor molecules.

The processing described above with reference to FIGS. 2 and 3 has difficulties associated therewith. For instance, a precipitate forms over time within electrophoretic deposition bath 50 which complicates repeated utilization of the deposition bath. Further, it is found that phosphor molecules deposited over conductive material 34 will occasionally be displaced by the isopropyl alcohol rinse to cause bleeding of phosphor colors and to reduce a total amount of phosphor ultimately formed over conductive material 34. It would be desirable to develop methodologies which overcome one or both of the above-described difficulties.

SUMMARY OF THE INVENTION

In one aspect, the invention encompasses a method of fabricating a display screen. Phosphor molecules are electrophoretically deposited onto a substrate in a first solution having a first concentration of hydroxide ions. The deposited phosphor molecules are then rinsed with a second solution having a second concentration of hydroxide ions greater than the first concentration of hydroxide ions.

In another aspect, the invention encompasses a method of depositing phosphor molecules over selected regions of a substrate. Conductive regions are formed over portions of a substrate while non-conductive regions are left over other portions of the substrate. Phosphor molecules are electrophoretically deposited onto the conductive regions of the substrate in a first solution having a first concentration of hydroxide ions. The substrate is then rinsed with a second solution having a second concentration of hydroxide ions. The second concentration of hydroxide ions is greater than the first concentration of hydroxide ions. After the rinsing, the deposited phosphor molecules are dried.

In yet another aspect, the invention encompasses a method of forming an FED device.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The present invention encompasses methods for electrophoretic deposition of phosphor molecules. In particular aspects, either the hydroxide ion concentration of an electrophoretic deposition solution is lower than the hydroxide ion concentration of prior art deposition solutions, or the hydroxide ion concentration of a rinse solution is higher than the hydroxide ion concentration of prior art rinse solutions. In other aspects, the hydroxide ion concentration of the deposition solution is lower than that of prior art deposition solutions and the hydroxide ion concentration of the rinse solution is higher than that of prior art rinse solutions. Any of the above-discussed aspects of the invention can be utilized to obtain substantially improved deposition results relative to prior art methodologies.

Figure 2:
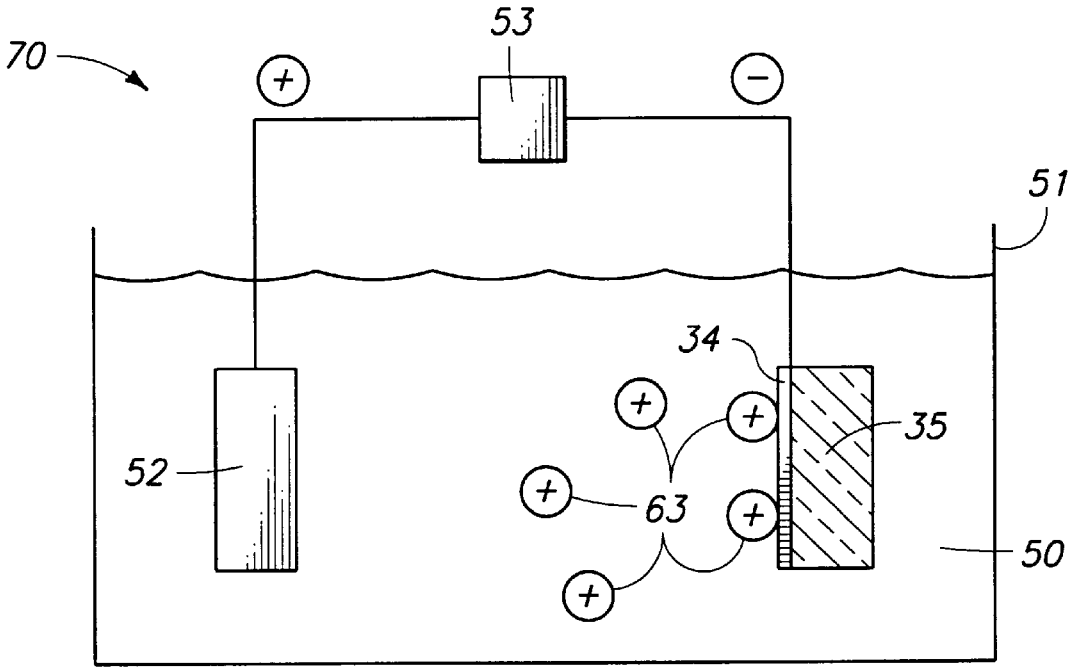
FIG 2 PRIOR ART
FIG. 2 is a diagrammatic cross-sectional side view of a prior art system for electrophoretic deposition of phosphor.

An exemplary deposition process encompassed by the present invention is described with reference to the block diagram of FIG. 4. In step (A), phosphor molecules are electrophoretically deposited on to a substrate in a first solution having a first concentration of hydroxide ions. The electrophoretic deposition can be accomplished utilizing a system similar to that discussed above with reference to prior art system 70 of FIG. 2. However, whereas prior art electrophoretic deposition of phosphor molecules utilized baths (such as the bath 50 of FIG. 2) having an hydroxide ion concentration of at least about $10^{-8}$ moles/liter, a preferred deposition process of the present invention utilizes a bath having an hydroxide ion concentration of less than $10^{-8}$ moles/liter. Such lowered hydroxide ion concentration relative to the prior art can be accomplished by adding an acid to a prior art deposition bath. Exemplary acids include weak organic acids (such as, for example, acetic acid) and inorganic acids (such as, for example, hydrochloric acid (HCl) and nitric acid ($HNO_3$)). The added acid is preferably provided to an amount of from about 10 milligrams to about gram per liter of deposition solution, with a preferred added amount being about 0.1 gram per liter of electrophoretic deposition solution. It is found that acid added in the above-indicated amounts does not appreciably interfere with electrophoretic deposition of phosphor from prior art deposition solutions. The final concentration of acid provided within a deposition bath will vary depending on the concentration of acid within the material added to the bath. In exemplary applications, the final concentration of acid within the bath will be from about 10 parts per million (ppm) to about 700 ppm.

The lowered hydroxide ion concentration of deposition solutions of the present invention (relative to prior art deposition solutions) is found to substantially reduce formation of precipitate in the deposition solutions of the present invention (relative to prior art deposition solutions) over time. To assist the reader in understanding the present invention, a possible mechanism is provided by which the lowered hydroxide ion concentration of deposition solutions of the present invention can reduce precipitate formation relative to prior art deposition solutions. However, it is to be understood that the mechanism is provided solely to assist a reader, and that the invention is not to be limited to such mechanism except to the extent that the mechanism is recited in the claims that follow. The mechanism is presented with a proposal that a reason for precipitate formation in prior art deposition solutions is that metal ion within the solutions combines with hydroxide ions to form a metal-hydroxide complex which is insoluble in the solution. The mechanism is therefore that reduction of the hydroxide ion concentration of the deposition bath in accordance with the present invention reduces an amount of hydroxide ion available to precipitate metal ions from the solution.

Figure 3:
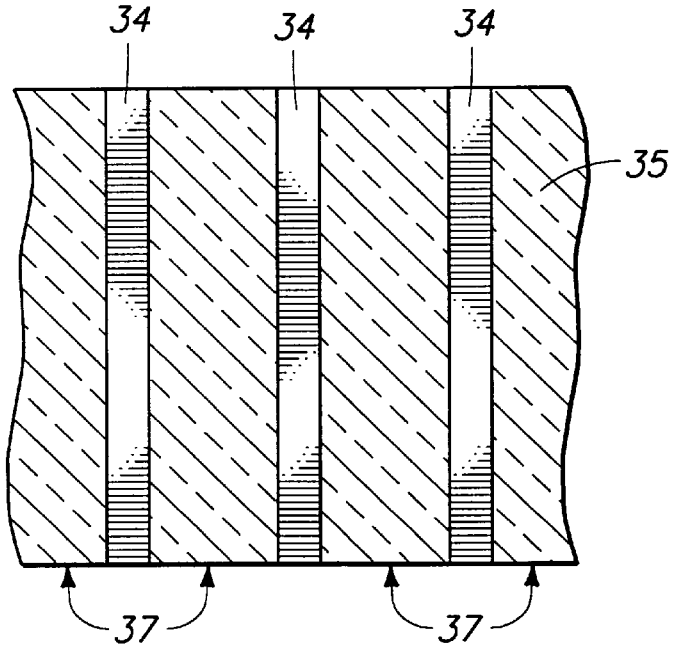
FIG 3 PRIOR ART
FIG. 3 is a diagrammatic, fragmentary top view of a face plate having a conductive material provided in a pattern thereover in accordance with a prior art processing method.

The electrophoretic deposition of step (A) forms a deposit of phosphor molecules over a substrate. The substrate can comprise, for example, the prior art conductive glass plate 35 of FIG. 3, and can accordingly have conductive regions (34) over portions of a substrate and non-conductive regions (37) over other portions of the substrate. In such applications, the phosphor will be deposited onto the conductive regions of the substrate.

Figure 4:
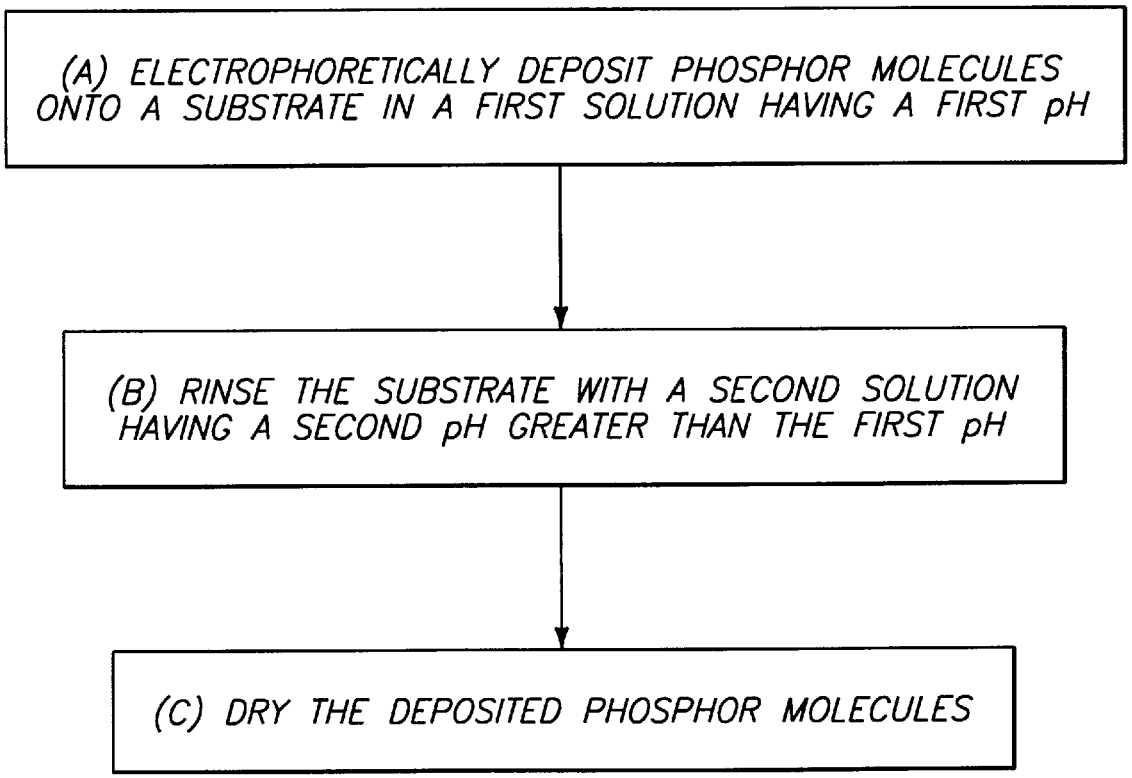
FIG. 4 is a block diagram description of a method encompassed by the present invention.

Referring to step (B) of FIG. 4, the substrate is preferably rinsed with a second solution having a concentration of hydroxide ions greater than the concentration of hydroxide ions in the deposition solution. As discussed above in the "Background" section of this disclosure, prior art methodology comprises rinsing a face plate with isopropyl alcohol after electrophoretically depositing phosphor onto the face plate. In contrast, the present invention encompasses utilizing a solution having an hydroxide ion concentration greater than the hydroxide ion concentration of the deposition solution utilized in step (A). Exemplary rinse solutions of the present invention have an hydroxide ion concentration of at least about 1 ppm, and preferably greater than 10 ppm. Such rinse solutions can be formed by, for example, dissolving a base selected from the group consisting of ammonium hydroxide ($NH_4OH$), sodium hydroxide (NaOH), potassium hydroxide (KOH), or mixtures of one or more bases, in the rinse solution. An exemplary solution comprises 10 ml of ammonium hydroxide in 100 ml of isopropyl alcohol. In a preferred embodiment, the rinse solution comprises greater than or equal to about 95% isopropyl alcohol, from trace to about 5% water, and a sufficient amount of base to adjust an hydroxide ion concentration of the solution to at least about $10^{-6}$ moles/liter, and preferably to greater than $10^{-5}$ moles/liter. In other preferred embodiments, the hydroxide ion concentration of the rinse solution of the present invention is greater than 10 parts per million (ppm).

The hydroxide ion concentration of particular rinse solutions of the present invention (i.e., $10^{-6}$ moles/liter) are higher than hydroxide ion concentrations of prior art rinse solutions utilized in phosphor deposition methodologies. It is found that the high hydroxide ion concentrations of rinse solutions of the present invention can alleviate prior art problems associated with displacing deposited phosphor from over conductive regions of a face plate. To assist the reader, a mechanism is proposed for such reduction in phosphor displacement. Such exemplary mechanism is provided solely to assist the reader, and is not to limit the invention except to the extent that the mechanism is recited in the claims that follow. The proposed mechanism has hydroxide ions from the rinse solution combining with positively charged metal ions remaining over conductive regions of a face plate to form a metal hydroxide which tightly bonds phosphor molecules to one another and the face plate.

Referring to step (C) of FIG. 4, the deposited phosphor molecules remaining on the face plate after the rinsing of step (B) are dried. Such drying can be accomplished utilizing methodology described above in the "Background" section., The above-described processes of the present invention can substantially improve phosphor deposition processes relative to the prior art processes (such as, for example, those described in the "Background" section) in that the methodologies of the present invention avoid difficulties associated with prior art deposition processes. Among the difficulties avoided are formation of precipitate in electrophoretic deposition solutions, and bleeding of deposited phosphor molecules during rinsing of a substrate after electrophoretic deposition.

Figure 1:
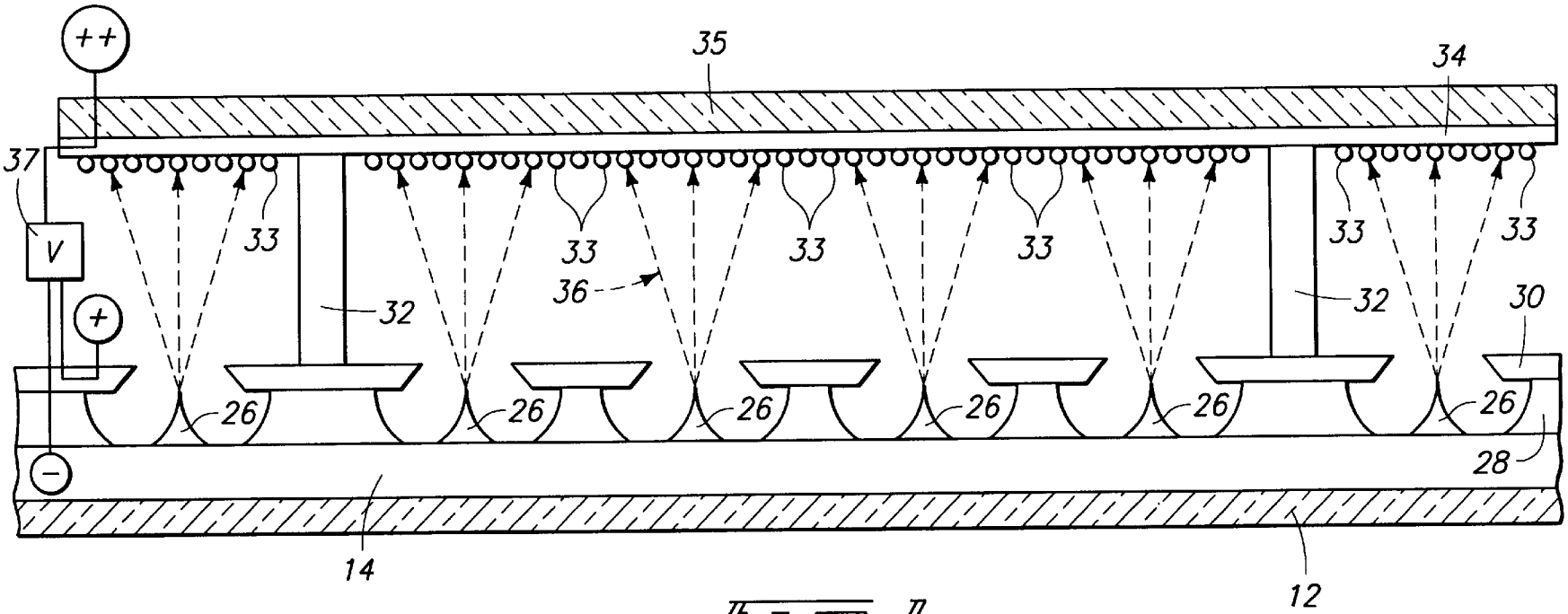
FIG. 1 PRIOR ART
FIG. 1 is a diagrammatic cross-sectional view of a prior art field emission display device.

After phosphor molecules are bound to a face plate in accordance with the present invention, the face plate can be incorporated into a phosphor-containing display device, such as, for example, a device similar 8 to FED device 40 of FIG. 1. Incorporation of the face plate into a device similar to the device 40 of FIG. 1 comprises providing a base plate (like the base plate 12) having emitters associated therewith (like the emitters 26) in spaced relation relative to the face plate. The emitters are provided in an orientation relative to the phosphor molecules such that electrons emitted from the emitters cause one or both of fluorescence or phosphorescence from the phosphor molecules.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of fabricating a display screen, comprising:

electrophoretically depositing phosphor molecules onto a substrate in a first solution having a first hydroxide ion concentration; and rinsing the deposited phosphor molecules with a second solution having a second hydroxide ion concentration greater than the first hydroxide ion concentration.

2. The method of claim 1 wherein the second hydroxide ion concentration at least about 10 ppm.

3. The method of claim 1 wherein the second hydroxide ion concentration at least about $10^{-6}$ moles/liter.

4. The method of claim 1 wherein the first hydroxide ion concentration is below $10^{-8}$ moles/liter.

5. The method of claim 1 wherein the first hydroxide ion concentration is below $10^{-8}$ moles/liter and the second hydroxide ion concentration is greater than about $10^{-6}$ moles per liter.

6. The method of claim 1 wherein the first hydroxide ion concentration is $10^{-8}$ moles/liter and the second hydroxide ion concentration is greater than about $10^{-5}$ moles per liter.

7. A method of fabricating a display screen, comprising:

electrophoretically depositing phosphor molecules onto a substrate;

before drying the deposited phosphor molecules, rinsing the deposited phosphor molecules with an aqueous solution comprising hydroxide ions to promote adherence of at least some of the deposited phosphor to the substrate; and drying the deposited phosphor molecules.

8. The method of claim 7 wherein the concentration of hydroxide ions within the aqueous solution is at least about $10^{-6}$ moles/liter.

9. The method of claim 7 wherein the substrate comprises a glass plate having a conductive layer provided thereover, and wherein the phosphor molecules are deposited onto the conductive layer.

10. The method of claim 7 wherein the substrate comprises a glass plate having an indium tin oxide layer provided thereover, and wherein the phosphor molecules are deposited onto the indium tin oxide layer.

11. A method of fabricating a display screen, comprising:

electrophoretically depositing phosphor molecules onto a substrate;

before drying the deposited phosphor molecules, rinsing the deposited phosphor molecules with a solution having an hydroxide ion concentration of at least about 10 ppm; and drying the deposited phosphor molecules.

12. The method of claim 11 wherein the substrate comprises a glass plate.

13. The method of claim 11 wherein the rinsing solution is an aqueous solution comprising an ionized base, the base being selected from the group consisting of $NH_4OH$, NaOH, KOH, and mixtures thereof.

* * * * *

UNITED STATES PATENT AND TRADEMARK OFFICE

CERTIFICATE OF CORRECTION

PATENT NO. : 6,203,681 B1
DATED : March 20, 2001
INVENTOR(S) : Jianping P. Yang

It is certified that error appears in the above-identified patent and that said Letters Patent is hereby corrected as shown below:

Title page, item [57],
Abstract,
Line 5, replace "with second" with -- with a second --.

Column 4,
Line 8, replace "on to" with -- onto --.
Line 24, add -- 1 --. after "about"

Column 5,
Line 59, delete "8".

Signed and Sealed this

Sixteenth Day of October, 2001

*Attest:*

Nicholas P. Godici

*Attesting Officer*

NICHOLAS P. GODICI
*Acting Director of the United States Patent and Trademark Office*